US009999325B2

(12) United States Patent
Larsson et al.

(10) Patent No.: US 9,999,325 B2
(45) Date of Patent: Jun. 19, 2018

(54) SEPARATION UNIT AND A DISPENSER COMPRISING A SEPARATION UNIT

(71) Applicant: SCA Hygiene Products AB, Gothenburg (SE)

(72) Inventors: Bjorn Larsson, Billdal (SE); Per Moller, Borlange (SE); Lars Thoren, Borlange (SE); Jari Haukirauma, Borlange (SE); Stig Pommer, Borlange (SE); Joonas Jokitalo

(73) Assignee: SCA HYGIENE PRODUCTS AB, Göteborg (SE)

( * ) Notice: Subject to any disclaimer, the term of this patent is extended or adjusted under 35 U.S.C. 154(b) by 0 days. days.

(21) Appl. No.: 14/438,442

(22) PCT Filed: Oct. 26, 2012

(86) PCT No.: PCT/SE2012/051160
§ 371 (c)(1),
(2) Date: Apr. 24, 2015

(87) PCT Pub. No.: WO2014/065731
PCT Pub. Date: May 1, 2014

(65) Prior Publication Data
US 2015/0282679 A1 Oct. 8, 2015

(51) Int. Cl.
*B65H 20/02* (2006.01)
*B65H 20/20* (2006.01)
(Continued)

(52) U.S. Cl.
CPC ..... *A47K 10/36* (2013.01); *A47K 10/3643* (2013.01); *A47K 10/38* (2013.01);
(Continued)

(58) Field of Classification Search
CPC .... A47K 10/16; A47K 10/36; A47K 10/3643; A47K 10/38; A47K 10/44
(Continued)

(56) References Cited

U.S. PATENT DOCUMENTS 804,307 A 11/1905 Fonda
2,886,226 A 3/1956 Batlas et al.
(Continued)

FOREIGN PATENT DOCUMENTS

CN 2527209 Y 12/2002
CN 101080188 A 11/2007
(Continued)

OTHER PUBLICATIONS

International Search Report (PCT/ISA/210) dated Jul. 1, 2013, by the Swedish Patent Office as the International Searching Authority for International Application No. PCT/SE2012/051158.
(Continued)

*Primary Examiner* — Rakesh Kumar
(74) *Attorney, Agent, or Firm* — Buchanan Ingersoll & Rooney PC

(57) ABSTRACT

A separation unit for separating a web material along preformed lines of weakness. The separation unit has a width direction and includes a first roller having a rotational axis extending in the width direction and a web width extending in the width direction, and a second roller having a rotational axis extending parallel with the rotational axis of the first roller and a web width extending in the width direction. The second roller is positioned at a distance from the first roller. Each of the first and the second rollers is provided with a plurality of protrusion elements being spaced along the rotational axes and protruding perpendicular from the axes. Each of the protrusion elements has a maximum width in the width direction, a maximum radial
(Continued)

extension from the rotational axes, an inner portion adjacent to the rotational axes, and an outer portion remote from the rotational axes.

24 Claims, 5 Drawing Sheets

(51) Int. Cl.

| | |
|---|---|
| ***B65H 51/04*** | (2006.01) |
| ***A47K 10/36*** | (2006.01) |
| ***A47K 10/44*** | (2006.01) |
| ***A47K 10/38*** | (2006.01) |
| ***B65H 35/10*** | (2006.01) |
| *A47K 10/42* | (2006.01) |
| *A47K 10/16* | (2006.01) |

(52) U.S. Cl.
CPC ..... *A47K 10/44* (2013.01); *B65H 35/10* (2013.01); *A47K 10/16* (2013.01); *A47K 10/3612* (2013.01); *A47K 10/426* (2013.01); *A47K 2010/3881* (2013.01)

(58) Field of Classification Search
USPC ..... 221/119, 121, 120, 167, 122, 43, 259, 221/277; 492/30, 38, 33, 34; 242/564.4
See application file for complete search history.

(56) References Cited

U.S. PATENT DOCUMENTS

| | | | | |
|---|---|---|---|---|
| 2,809,082 | A | 10/1957 | Marcuse | |
| 2,974,839 | A | 7/1958 | Batlas et al. | |
| 3,826,548 | A | 7/1974 | Schnyder et al. | |
| 3,877,576 | A | 4/1975 | Kishi et al. | |
| 4,089,378 | A | 5/1978 | Suzuki | |
| 4,288,068 | A | 9/1981 | Hashimoto et al. | |
| 4,494,747 | A * | 1/1985 | Graef | B65H 3/0638 221/21 |
| 4,516,711 | A | 5/1985 | Barege | |
| 4,614,632 | A * | 9/1986 | Kezuka | B29C 51/08 264/280 |
| 4,779,861 | A * | 10/1988 | Ozawa | B65H 3/06 271/119 |
| 4,861,013 | A * | 8/1989 | Shibata | B65H 3/5261 271/119 |
| 5,033,620 | A | 7/1991 | De Luca | |
| 5,061,232 | A * | 10/1991 | Bloch | A47K 10/34 242/564.4 |
| 5,098,078 | A * | 3/1992 | Nakanishi | B65H 3/0653 271/10.11 |
| 5,152,522 | A | 10/1992 | Yamashita | |
| 5,205,454 | A | 4/1993 | Schutz et al. | |
| 5,372,359 | A * | 12/1994 | Miura | B65H 3/0638 271/119 |
| 5,375,785 | A * | 12/1994 | Boone | A47K 10/26 242/560.1 |
| 5,653,439 | A | 8/1997 | Rider et al. | |
| 5,882,004 | A * | 3/1999 | Padget | B65H 3/0607 271/119 |
| 5,975,518 | A * | 11/1999 | Wakana | B65H 3/5223 271/117 |
| 6,070,867 | A * | 6/2000 | Tsurumi | B65H 3/0669 271/114 |
| 6,186,490 | B1 * | 2/2001 | Sugiura | B65H 3/0638 271/10.09 |
| 6,213,346 | B1 | 4/2001 | Skerrett et al. | |
| 6,311,819 | B1 * | 11/2001 | Stromme | G07D 7/00 194/207 |
| 6,520,408 | B1 * | 2/2003 | Force | B65H 3/047 235/379 |
| 6,655,679 | B2 * | 12/2003 | Boucher | B65H 3/0676 271/10.09 |
| 6,736,466 | B1 | 5/2004 | Helland et al. | |
| 7,144,006 | B2 * | 12/2006 | Graef | B65H 3/06 271/109 |
| 7,182,329 | B2 * | 2/2007 | Graef | B65H 3/06 271/109 |
| 7,191,657 | B2 * | 3/2007 | Maier | G07D 7/164 73/159 |
| 7,195,237 | B2 * | 3/2007 | Graef | B65H 3/06 271/121 |
| 7,344,132 | B2 * | 3/2008 | Graef | B65H 3/06 271/119 |
| 7,472,802 | B2 | 1/2009 | Van Riel | |
| 8,899,508 | B2 * | 12/2014 | Hjort | A47K 10/36 242/564.4 |
| 2001/0020626 | A1 * | 9/2001 | Skerrett | A47K 10/42 221/48 |
| 2002/0033405 | A1 | 3/2002 | Gergek | |
| 2003/0110915 | A1 | 6/2003 | Kapiloff et al. | |
| 2003/0121970 | A1 * | 7/2003 | Force | B65H 3/047 235/379 |
| 2005/0275153 | A1 | 12/2005 | Owa | |
| 2007/0010389 | A1 | 1/2007 | Cutrona et al. | |
| 2007/0236110 | A1 | 10/2007 | Kling | |
| 2008/0023905 | A1 * | 1/2008 | Graef | B65H 3/06 271/109 |
| 2008/0121649 | A1 | 5/2008 | Kistner | |
| 2010/0258579 | A1 | 10/2010 | Billman et al. | |
| 2011/0089213 | A1 | 4/2011 | Granger | |
| 2011/0101020 | A1 | 5/2011 | Granger | |
| 2011/0210137 | A1 | 9/2011 | Kling | |
| 2012/0193463 | A1 | 8/2012 | Newhouse et al. | |
| 2012/0211509 | A1 | 8/2012 | Granger | |
| 2013/0105614 | A1 * | 5/2013 | Hjort | A47K 10/36 242/564.5 |
| 2013/0277492 | A1 | 10/2013 | Granger | |
| 2015/0282678 | A1 | 10/2015 | Larsson et al. | |
| 2015/0282679 | A1 * | 10/2015 | Larsson | A47K 10/3643 221/26 |
| 2015/0282680 | A1 | 10/2015 | Larsson et al. | |
| 2015/0297042 | A1 | 10/2015 | Larsson et al. | |

FOREIGN PATENT DOCUMENTS

| | | | |
|---|---|---|---|
| CN | 102395307 | A | 3/2012 |
| CN | 202173351 | U | 3/2012 |
| EP | 0236709 | A1 | 9/1987 |
| EP | 0392696 | A1 | 10/1990 |
| FR | 853 284 | A | 3/1940 |
| GB | 2 433 248 | A | 6/2007 |
| JP | 2011-194125 | A | 10/2011 |
| WO | 2004056250 | A1 | 6/2004 |
| WO | WO 2006/071148 | A1 | 7/2006 |
| WO | WO 2007/000153 | A1 | 1/2007 |
| WO | 2008/009760 | A2 | 1/2008 |
| WO | WO 2008/078168 | A1 | 7/2008 |
| WO | WO 2011/045493 | A1 | 4/2011 |
| WO | WO 2011/149393 | A1 | 12/2011 |
| WO | WO 2012/003867 | A1 | 1/2012 |
| WO | 2012/076776 | A1 | 6/2012 |
| WO | 2013/184049 | A1 | 12/2013 |

OTHER PUBLICATIONS

Written Opinion (PCT/ISA/237) dated Jul. 1, 2013, by the Swedish Patent Office as the International Searching Authority for International Application No. PCT/SE2012/051158.

International Preliminary Report on Patentability (PCT/IPEA/409) dated Jan. 29, 2015, by the Swedish Patent Office as the International Preliminary Examining Authority for International Application No. PCT/SE2012/051158.

Written Opinion of the International Preliminary Examining Authority (PCT/IPEA/408) dated Nov. 10, 2014, by the Swedish Patent Office as the International Preliminary Examining Authority for International Application No. PCT/SE2012/051158.

PCT Demand (PCT/IPEA/401) dated Mar. 11, 2014, by the Swedish Patent Office as the International Preliminary Examining Authority for International Application No. PCT/SE2012/051158.

(56) References Cited

OTHER PUBLICATIONS

International Search Report (PCT/ISA/210) dated Dec. 2, 2013, by the Swedish Patent Office as the International Searching Authority for International Application No. PCT/SE2013/050204.
Written Opinion (PCT/ISA/237) dated Dec. 2, 2013, by the Swedish Patent Office as the International Searching Authority for International Application No. PCT/SE2013/050204.
International Preliminary Report on Patentability (PCT/IPEA/409) dated Mar. 31, 2014, by the Swedish Patent Office as the International Preliminary Examining Authority for International Application No. PCT/SE2013/050204.
PCT Demand (PCT/IPEA/401) dated Mar. 31, 2014, by the Swedish Patent Office as the International Preliminary Examining Authority for International Application No. PCT/SE2013/050204.
International Search Report (PCT/ISA/210) dated Jul. 8, 2013, by the Swedish Patent Office as the International Searching Authority for International Application No. PCT/SE2012/051160.
Written Opinion (PCT/ISA/237) dated Jul. 8, 2013, by the Swedish Patent Office as the International Searching Authority for International Application No. PCT/SE2012/051160.
An English Translation of the Office Action (Decision on Grant) dated Apr. 28, 2016, by the Federal Service for Intellectual Property Office in Russian Patent Application No. 2015119664/12. (6 pages).
The extended European Search Report dated May 6, 2016, by the European Patent Office in corresponding European Patent Application No. 12887211.6-1601. (9 pages).
The extended European Search Report dated May 6, 2016, by the European Patent Office in European Patent Application No. 12887301.5-1601. (8 pages).
An English Translation of the Official Action/Search Report dated May 17, 2016, by the Federal Service for Intellectual Property Office in Russian Patent Application No. 2015119242/12. (9 pages).
The extended European Search Report dated Jun. 29, 2016, by the European Patent Office in European Patent Application No. 13848737.6-1601. (8 pages).
Office Action (Notification of the First Office Action) dated Sep. 19, 2016, by the state intellectual property office (SIPO) of the People's Republic of China in corresponding Chinese Patent Application No. 201280076556.8, and an English Translation of the Office Action. (5 pages).
Office Action (Notification of the second Office Action) dated Apr. 10, 2017, by the State Intellectual Property Office (SIPO) of the People's Republic of China in Chinese Patent Application No. 201280076596.2, and an English Translation of the Office Action. (21 pages).
Office Action (Notification of the second Office Action) dated May 10, 2017, by the State Intellectual Property Office (SIPO) of the People's Republic of China in Chinese Patent Application No. 201280076557.2, and an English Translation of the Office Action. (20 pages).
Office Action (Communication pursuant to Article 94(3) EPC) dated Oct. 2, 2017, by the European Patent Office in the European Patent Application No. 12 887 301.5-1601. (5 pages).
Office Action (Notification of the third Office Action) dated Aug. 21, 2017, by the State Intellectual Property Office (SIPO) of the Peoples Republic of China in the Chinese Patent Application No. 201280076596.2, and an English Translation of the Office Action. (21 pages).
Office Action (Communication pursuant to Article 94(3) EPC) dated Sep. 4, 2017, by the European Patent Office in corresponding European Patent Application No. 12 887 211.6-1601. (5 pages).
Office Action (Notification of the First Office Action) dated Sep. 20, 2016, by the State Intellectual Property Office (SIPO) of the People's Republic of China in Chinese Patent Application No. 201280076596.2, and an English Translation of the Office Action. (19 pages).
The extended European Search Report dated Jun. 29, 2016, by the European Patent Office in European Patent Application No. 12886996.3-1601. (7 pages).
European Patent Office dated Aug. 22, 2014. (4 pages).
Notification of Transmittal of the International Preliminary Report on Patentability (Forms PCT/IPEA/416 and PCT/IPEA/409) dated Jan. 16, 2015, by the European Patent Office in the International Application No. PCT/SE2012/051164. (7 pages).
Notification of Transmittal of the International Search Report and the Written Opinion of the International Searching Authority (Forms PCT/ISA/220, PCT/ISA/210 and PCT/ISA/237) dated Jun. 18, 2013, by the Swedish Patent Office in the International Application No. PCT/SE2012/051164. (12 pages).
Written Opinion of the International Preliminary Examining Authority (Form PCT/IPEA/408) dated Oct. 22, 2014, by the European Patent Office in the International Application No. PCT/SE2012/051164. (6 pages).

* cited by examiner

SEPARATION UNIT AND A DISPENSER COMPRISING A SEPARATION UNIT

TECHNICAL FIELD

The present invention concerns a separation unit for separating a perforated web material such as paper towels, tissue paper or nonwoven material along the perforation lines.

The present invention further relates to a dispenser for a web material, comprising a housing defining a web material reservoir, a dispensing opening, a control unit, and said separation unit.

BACKGROUND OF THE INVENTION

Automatic touchfree dispensers (or "hands-free dispensers") for paper towels are known on the market. The hands-free dispensers are electronically maneuvered, they store and advance the paper towel with different kinds of control devices, sensors and power sources available. Without touching the dispenser, the user can get a paper towel that is fed automatically by the electronic dispenser. Dispensers like this are commonly used in public lavatories for dispensing paper towels to users. The most common type of a powered, hands-free dispenser is a roll dispenser that users sensors to initiate the mechanisms for advancing the towel such that the subsequent sheet is presented to the user.

Rolls of paper towels are often heavy and there is a friction and resistance for unrolling the paper. Especially when the roll is accelerated there is a high demand of energy. Consequently, there is a need for a strong paper in order to withstand the force necessary to make a full heavy roll to start rotating. A strong paper usually has drawbacks in that the softness of the paper is low. In addition, hands-free dispensers for rolled paper towels demand a large amount of space due to the relatively large volume of the heavy paper rolls.

As an alternative to rolls of paper towels, US2011/0101020, WO 2011/045493, EP 1 830 687 all disclose dispensing units comprising a housing for holding a pile of a continuous length of accordion-like folded web of towels. The dispenser comprises an access opening to the pile, a dispensing opening for the web of towels, a feeding mechanism comprising a member for controlling the dispensing of the web of towels, and a drive unit. Bundles of paper towels with connecting means therebetween are insertable through the access opening into the housing in the dispensing unit and may be added to the bottom of the pile. The web of towels is dispensable from the upper part of the pile by the feeding mechanism, which positions the web of towels in a starting mode in the dispensing opening. This solution enables feeding of a large amount of wipe products while avoiding the problems relating to the weight of a heavy paper roll or large pile. Preferably, the folded web material comprises a double folded perforated web material, where two perforated webs are interfolded, such that the perforations are arranged in an off-set relationship to each other. A separation unit enables the wipe products to be separated at the lines of weakness when the web is pulled by the user. This feature will allow the feeding of the products to be performed manually by the user, hence avoiding any additional arrangements of the dispensers such as electrical power.

However, to realize the dispenser as described above a number of problems must be solved, including separating the webs correctly along the perforation lines, feeding the next portion of the web to be separated to the separation unit, and presenting the leading end of the web to the next user. Furthermore, separation shall be possible for different types of web materials and web materials having different lengths between the perforation lines.

GB 2 433 248 describes a dispenser for feeding a rolled material comprising two perforated webs, wherein the perforations are in offset relationship. The dispenser comprises two profiled rollers being arranged to form a non-linear nip, applying pressure to the sheet material so that the lines of weakness of the web material would burst. The nip is formed by protrusion elements of different sizes arranged on two rollers. It is shown that the surfaces of each pair of opposing protrusion elements are always in contact with each other.

WO 2011/1149393 describes a dispenser for feeding a rolled tissue or nonwoven material, which may be provided with perforations. A problem with perforated webs is defined, relating to the fact that the web tends to break at every perforation, but that the user might sometimes wish to use a long section of web and sometimes a short section of web. For feeding the web in the dispenser, there is provided a drive roller and an engaging roller. The drive roller and the engaging roller are arranged such that an undulated passage is defined between the protrusion elements on the rollers. It is stated that the undulated passage ensures that the dispensing end of the web is in contact with both the drive roller and the engaging roller in the passage. Also, a pulling force exerted substantially straight out from the dispensing passage is distributed evenly over a central portion of the web, which results in that the web will not break even if perforated, until the user chooses to apply a force sideways. The separation is thus done by the user rather than by the dispenser itself.

It is therefore an object of the present invention to provide a separation unit eliminating the above-mentioned problems.

SUMMARY OF THE INVENTION

According to the present invention, a separation unit for separating a web material along preformed lines of weakness is provided. The separation unit has a width direction and comprises a first roller having a rotational axis extending in the width direction and a web width extending in said width direction, and a second roller having a rotational axis extending parallel with the rotational axis of the first roller and a web width extending in said width direction. A web width of a roller is a portion of the roller extending along the width direction of the roller. Over the web width of the roller the web material is arranged to pass during dispensing of the web material. The second roller is positioned at a distance from the first roller. The distance between the rollers extends in a direction perpendicular to the width direction. The rollers are thus positioned such that the rotational axes are juxtaposed. The separation unit may also comprise more than two rollers, positioned at a distance from each other, wherein the distance between the rollers extends in a direction perpendicular to the width direction.

Each of said first and said second rollers is provided with a plurality of protrusion elements being spaced along said rotational axes and protruding radially perpendicular from said axes. Each of said protrusion elements has a maximum width in said width direction, a maximum radial extension from said rotational axes, an inner portion adjacent to said rotational axes, and an outer portion remote from said rotational axes. By "maximum width" is meant the maximal extension of the protrusion element in the width direction. By "maximum radial extension" is meant the distance from the rotational axis of the roller to the most remote point on the protrusion element in the radial direction being perpendicular to the width direction of the rotational axis.

The outer portions of the protrusion elements on said first roller are arranged in a staggered relationship with the outer portions of the protrusion elements on the second roller. In other words, the rollers and the protrusion elements are placed such that the protrusion elements on the first roller are positioned in between the protrusion elements on the second roller. Further, the outer portions of the protrusion elements on said first roller are partially overlapping with said outer portions of said protrusion elements on said second roller along an imaginary line extending in a width direction with a radial overlap length, whereby an undulating passage for a web material is formed between said rollers such that the shape of the passage for a web material formed between the protrusion elements is meandering along the imaginary line. For at least one of the rollers, the sum of the maximum widths within the overlap length of all protrusion elements on that roller is between 5-30%, preferably between 12-20% of the web width of that roller. By "maximum width within the overlap length" is meant the maximal extension of the protrusion element in the width direction within the overlap length. Thus, the surface of the web material being in contact with the protrusion elements is relatively small compared to the separation units of the prior art, which optimizes the pinch force acting on the web material and provides an accurate separation.

The overlap between the protrusion elements has a radial overlap length between 2-40 mm, preferably 2-20 mm, more preferably 3-12 mm, or most preferably between 4-10 mm. Surprisingly, it has been found that when the radial overlap length is in the range mentioned above, preformed lines of weakness are correctly and easily broken, thus allowing an accurate and smooth separation of the web material. Without wishing to be bound by a theory, the inventor believes that this effect is achieved due to the "wrinkling" of the web material in the passage. This wrinkling causes local tension in the web material, which causes the material to burst as the preformed lines of weakness pass through the undulating passage. It is worth noting that the pinch force exercised by the separation unit of the present invention is strong enough to break the preformed lines of weakness, and at the same time weak enough not to damage the web material. Such an optimization of the pinch force is achieved due to the unique geometry of the separation unit.

Thus, by using the separation unit according to the present invention, the risk that any given preformed line of weakness would break before that particular line of weakness has reached the separation unit is eliminated. At the same time, the separation unit according to the present invention facilitates the separation of the web material such that the force needed for separation of the web material is minimized.

The web material mentioned above may in the context of the present invention be tissue paper, such as facial tissue, toilet tissue or paper towels, or may be nonwoven material. As would be understood by the person skilled in the art, the pinch force needed for accurate separation of the web material may need to be altered depending on the type of the web material. In order to provide the separation unit according to the present invention being usable with different types of web material, the distance between the rotational axes of the first and second rollers may be adjustable, thus enabling the radial overlap length in the undulating passage to be variable. This feature of the separation unit makes it very flexible and adaptive.

The protrusion elements of the separation unit according to the present invention may be of any suitable shape, as far as the radial overlap length is within the range specified above. Thus, the protrusion elements may be in the form of disc elements, propeller-shaped elements, cylinder elements or the like. The cross-section in a radial plane of the protrusion elements may be rounded at the outer periphery of the protrusion element. The cross-section at the outer periphery of the protrusion element may also be rectangular, triangular, wavy or the like. The maximum radial extensions of said protrusion elements may be between 5-50 mm, preferably 5-30 mm, more preferably 10-20 mm, or most preferably 12-18 mm.

The protrusion elements may be made of any suitable material that provides friction between the outer portion of the protrusion element and the web material. Thus, the protrusion elements may be made of rubber or another elastomeric material.

The protrusion elements may be covered by a sleeve or ring of an elastomeric material encircling the outer periphery of each individual protrusion element. The elastomeric material may be glued, vulcanized or simply stretched around the outer portion of the protrusion element.

The maximum widths of said protrusion elements may be between 4-20 mm, preferably 5-10 mm, most preferably 6-8 mm. As mentioned above, the maximum width of each protrusion element is determined by the dimension of the widest part of the protrusion element. The width of the protrusion element may be same or different along the radial direction. Thus, if the width of the protrusion element is the same along the radial direction, the maximum width within the overlap length is equal to the maximum width of the protrusion element. On the other hand, if the width of the protrusion element is different along the radial direction, the maximum width within the overlap length may be smaller or greater than the maximum width of the protrusion element.

The maximum radial extensions of the protrusion elements may be equal to or greater than the maximum widths of said protrusion elements. The more the difference between the maximum radial extensions and the maximum widths of the protrusion elements, the greater the undulation amplitude of the passage formed between the protrusion elements. This, in turn, means that with increasing undulation amplitude the pinch force increases.

The separation unit according to the present invention may be formed such that the protrusion elements are formed integral with the rollers, or such that the protrusion elements are separate units attached to the roller.

The spacing of the protrusion elements may be the same along the width direction of the first and/or said second roller. Also, the spacing of the protrusion elements may vary along the width direction of the first and/or said second roller. For instance, one of said first and said second rollers may comprise at least a first, a second and a third protrusion element, wherein the spacing between said first and said second protrusion elements along the width direction of said first and/or said second roller differs from the spacing between said second and said third protrusion elements along the width direction of said first and/or said second roller. The protrusion elements may be sparsely arranged in the central portion of the rollers, and concentrated in the peripheral portions of the rollers. If such an arrangement is used, a wrinkleless portion of the web material in the central portion of the roller may be more suitable for gripping by the user when the web material is to be separated.

As mentioned above, the distance between the rotational axes of the first and second rollers may be adjustable, thus enabling the radial overlap length in the undulating passage to be variable. Thus, the rollers may be arranged such that the distance between the rollers is manually changed depending on the type of the web material. Another alternative is that the distance between the rollers is automatically adjustable to provide an optimal separation. Such an automatic adjustment may be enabled by using rollers arranged with a biasing means. The biasing means may be a spring suspension, or suspension acting by gravity. Biasing means facilitate pulling the material through the separation unit when the dispenser is being loaded with a web material. Also, biasing means provides a flexible separation unit enabling a smooth passage of parts of the web material having thickness greater than the web material itself. Such parts may for instance be joints between two bundles of the web material. The distance between said rotational axes of said first and said second rollers may be between 8-100 mm. As will be understood by the person skilled in the art, the distance between the rotational axes may be chosen such that an undulating passage providing an optimal pinch force is formed depending on the type of the web material.

The separation unit according to the present invention may comprise protrusion elements having the same maximum radial extensions and same maximum widths. In other words, all the protrusion elements may be equally sized. The separation unit according to the present invention may comprise protrusion elements having different maximum radial extensions and/or different maximum widths, i.e. the separation unit comprises protrusion elements of different sizes. Thus, a plurality of radial overlaps having different lengths will be formed for every given distance between the rotational axes. It has been found that the performance of the separation unit according to the present invention is improved when the spacing between each two protrusion elements is equal to or greater than the maximum width of each protrusion element. Such a relationship between the spacing between the protrusion elements and the maximum widths of the protrusion elements provides for a scarce distribution of the protrusion elements along the rotational axes, which optimizes the pinch force affecting the web material, and facilitates separation of the web material at the desired position.

The separation unit according to the present invention may comprise protrusion elements wherein the maximum radial extensions of the protrusion elements are equal to or greater than said maximum widths of said protrusion elements. This means that the protrusion elements may be relatively large and thin, which contributes to an optimal pinch force of the web material.

The separation unit according to the present invention may be placed in a dispenser. Such a dispenser may comprise a housing defining a web material reservoir, a dispensing opening, a control unit for determining a correct tension and path of the web material, and a separation unit according to the present invention. The dispenser may further comprise a web material contained inside the housing. The web material comprises preformed lines of weakness and may be Z-folded to form a stack, or being in the form of a roll.

A leading portion of the web material is configured to be supported in a dispensing path from the reservoir to the dispensing opening. The leading portion may extend upwardly from the top of the said stack of said web material, or from the peripheral or central part of the roll.

The preformed lines of weakness may be perforation lines formed by alternating bonds and slots and having the perforation strength between 20-80 N/m, preferably 30-45 N/m measured using SS-EN ISO 12625-4:2005. This perforation strength may for instance be achieved by using perforation lines wherein the total bond length/(the total bond length+total slot length) is between 4% and 10%. It is desired to form perforation lines which are strong enough to enable feeding of the web material, but which are also weak enough to enable separation of the sheets along the perforation lines using the separation unit of the present invention. In this context, it is known that also other parameters may influence the strength of the perforation line, such as the paper quality, and the size, shape and distribution of the slots and bonds. However, it is believed that the above-mentioned measure is useful for guiding the person skilled in the art when selecting suitable perforation lines.

The web material may be a two-layer structure, i.e. the web material may comprise at least a first web layer divided into sheet products defined between longitudinally separated preformed lines of weakness extending across the first layer; and at least a second web layer divided into sheet products defined between longitudinally separated lines of weakness extending across the second web layer. The web layers may be interfolded so that the lines of weakness of the first web layer are offset from the lines of weakness of the second web layer in a longitudinal direction.

Further, the dispenser may comprise a feeding mechanism, i.e. a motor to advance a web through the dispenser.

BRIEF DESCRIPTION OF THE DRAWINGS

Embodiments of the invention will now be described by way of example with reference to the accompanying drawings, of which.

DETAILED DESCRIPTION OF PREFERRED EMBODIMENTS

Figure 1A:
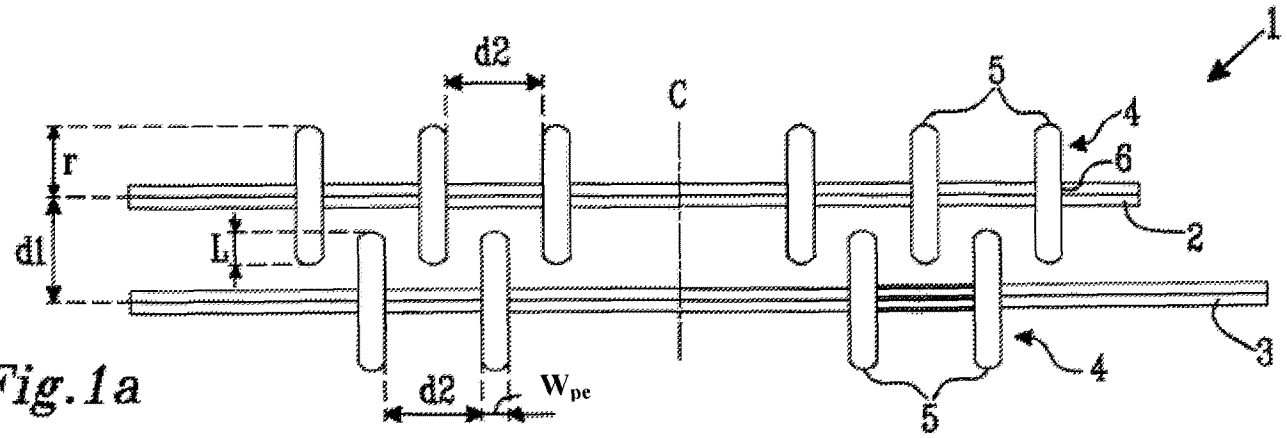
FIGS. 1*a*, 1*b* and 1*c* show a separation unit according to the present invention.
Figure 1B:
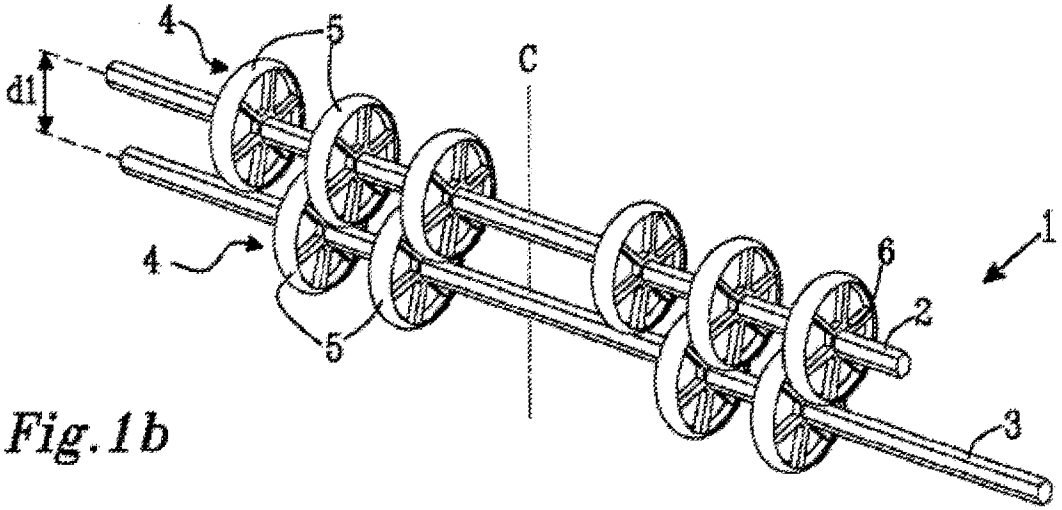
Figure 1C:
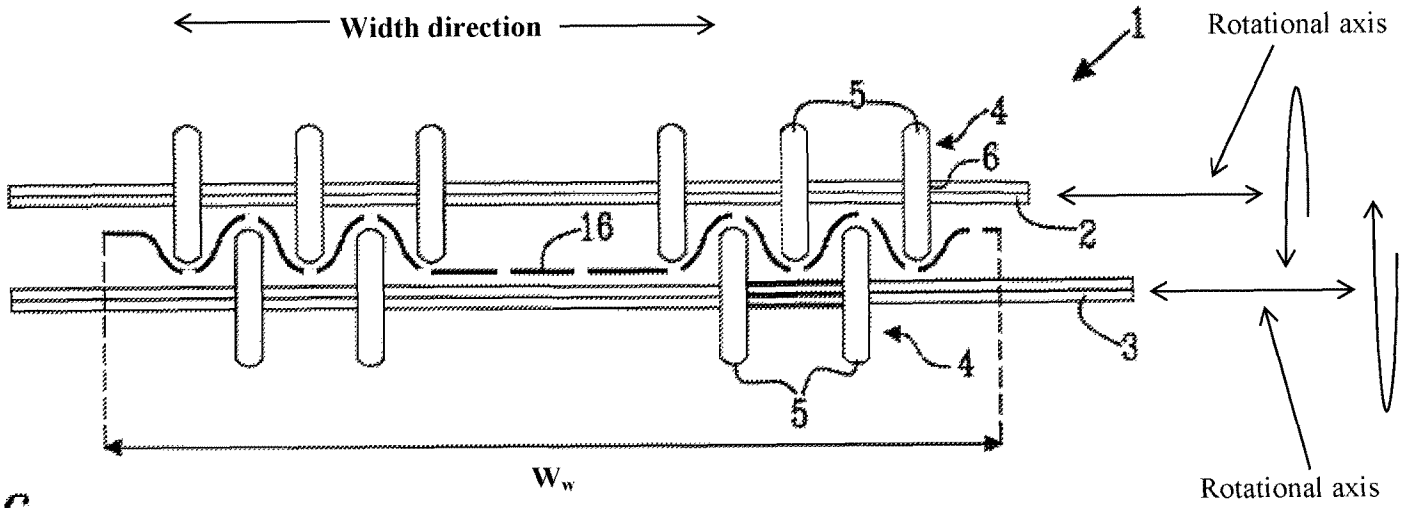
Figure 2:
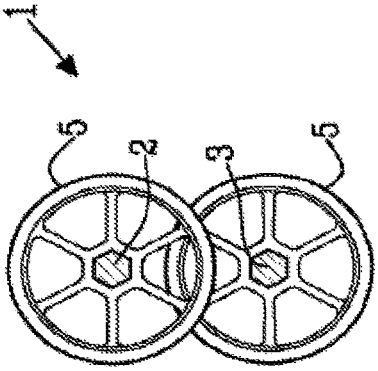
FIG. 2 shows the separation unit according to the present invention seen in the width direction.

FIGS. 1*a* and 1*b* show a separation unit 1 according to the present invention. The separation unit 1 comprises a first roller 2 and a second roller 3, each extending in a width direction and comprising plurality of protrusion elements 4 being spaced along the rollers 2, 3 and protruding perpendicular from the rollers 2, 3. The rollers 2, 3 are positioned at a distance d.sub.1 from each other, wherein the distance d.sub.1 is extending in a direction perpendicular to the width direction of the rollers 2, 3. In the embodiment shown in FIG. 1*a*, the first roller 2 comprises six protrusion elements 4, and the second roller 3 comprises four protrusion elements 4. The separation unit 1 has a web width $W_w$ (FIG. 1*c*). Each of the protrusion elements 4 has a maximum width $W_{pe}$ in the width direction and a maximum radial extension r from the rollers 2, 3. In the embodiment shown in FIG. 1*a*, the maximum widths $W_{pe}$ and the maximum radial extensions r of all the protrusion elements 4 are the same. Each protrusion element has an inner portion 6 adjacent to the rollers 2, 3, and an outer portion 5 remote from the rollers 2, 3, wherein the outer portions 5 of the protrusion elements 4 on the first roller 2 are arranged in a staggered relationship with the outer portions 5 of the protrusion elements 4 on the second roller 3, which is best seen in FIG. 2. The outer portions 5 of the protrusion elements 4 have a slightly curved shape. The outer portions 5 of the protrusion elements 4 on the first roller 2 are partially overlapping with the outer portions 5 of the protrusion elements 4 on the second roller 3 with a radial overlap length L. Such a configuration of the protrusion elements forms an undulating passage for a web material between the rollers 2, 3 (FIG. 1*c*).

In the embodiment shown in FIGS. 1*a* and 1*b*, no protrusion elements are placed in the central portion C of the rollers 2, 3. Such an arrangement of the protrusion elements allows the user to easily access the leading end of the web material 16 in the central portion C of the separation unit 1 (FIG. 1*c*).

As may be seen in FIGS. 1*a* and 1*b*, the spacing $d_2$ between each two protrusion elements 4 is equal to or greater than the maximum width w of each protrusion element 4. Such a configuration enables the protrusion elements 4 to be relatively scarcely distributed, which provides an optimal pinch force.

Another advantageous feature of the separation unit according to the present invention is that the maximum radial extensions r of the protrusion elements are equal to or greater than the maximum widths $W_{pe}$ of the protrusion elements. As may be seen in FIGS. 1*a* and 1*b*, the protrusion elements are formed as relatively large and thin discs, which optimizes the pinch force.

FIG. 2 illustrates the separation unit 1 seen in the width direction. It is clearly shown that the outer portions 5 of the protrusion elements 4 on the first roller 2 overlap with the outer portions 5 of the protrusion elements 4 on the second roller 3.

Figure 3:
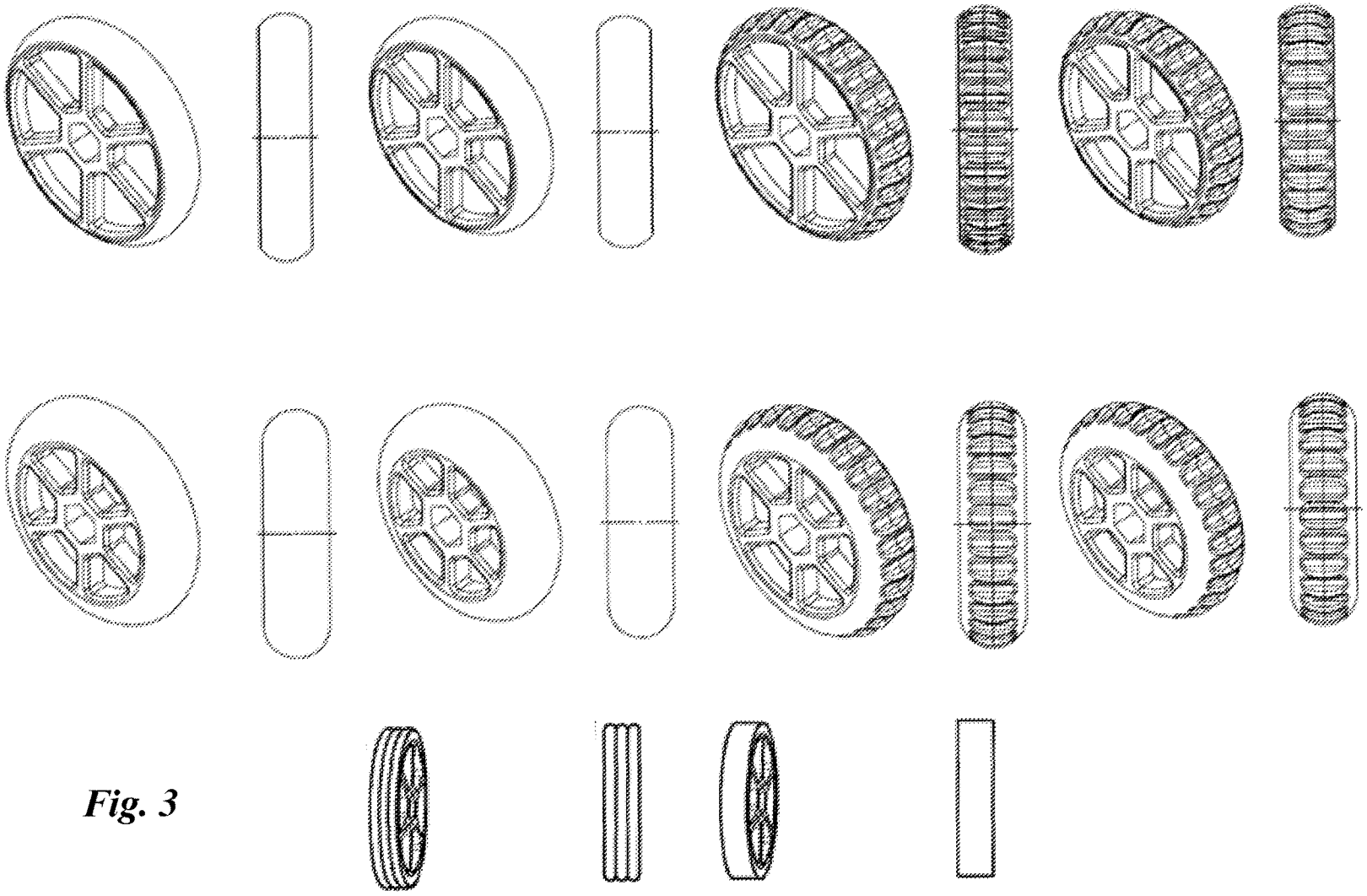
FIG. 3 shows protrusion elements having different dimensions and differently shaped outer portions.

As previously mentioned, the protrusion elements 4 may have different maximum widths $W_{pe}$ and maximum radial extension r. In FIG. 3, protrusion elements having different maximum widths $W_{pe}$ and different maximum radial extensions r are shown.

As mentioned above, the shape of the outer portions 5 of the protrusion elements 4 may vary. In FIG. 3, four other possible shapes of the outer portions 5 are depicted. Thus, the outer portions may have smooth surface, or may be provided with ribbed surface. As will be understood by the person skilled in the art, if the surfaces of the outer portions of the protrusion elements are ribbed, the friction between the web material and the outer surfaces of the protrusion elements, and thus the pinch force, is greater compared to the friction provided by smooth surfaces.

Figure 4:
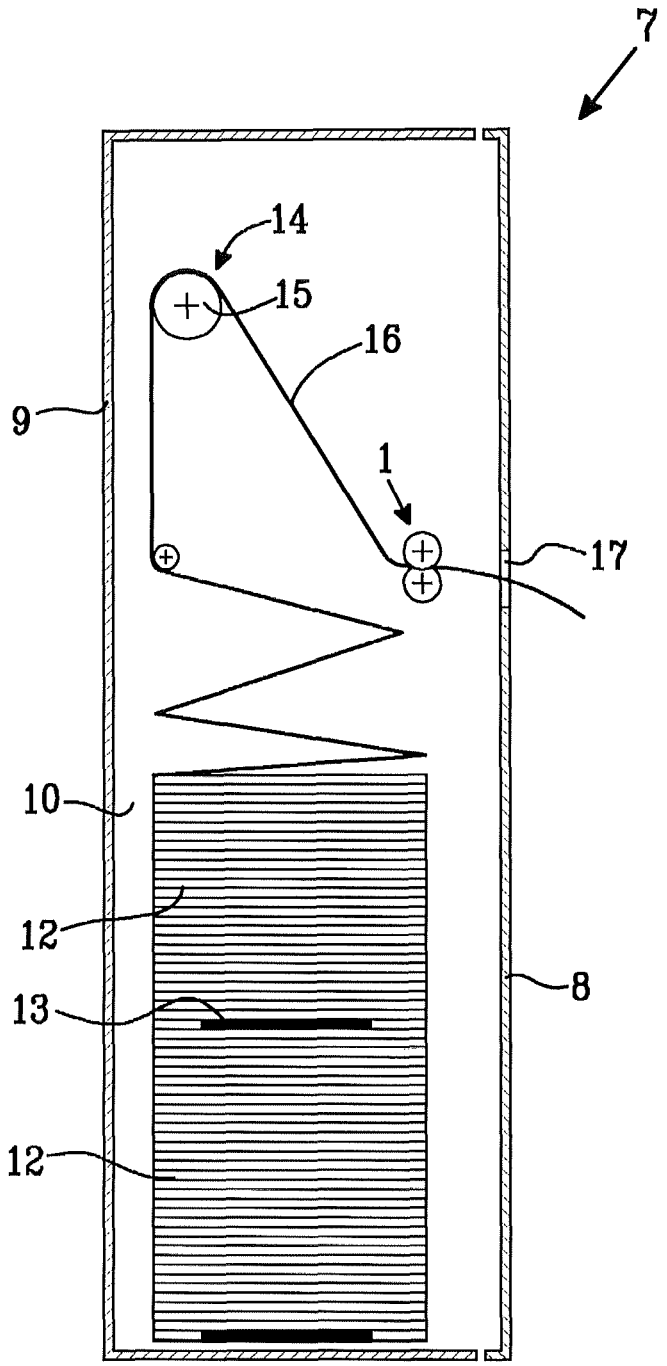
FIGS. 4 and 5 show a dispenser comprising the separation unit according to the present invention.

FIG. 4 schematically shows a dispenser 7 with a separation unit 1 according to the present invention. The dispenser 7 has an outer front wall 8, two outer side walls 9 and a housing 10. The housing 10 is intended for holding a pile of a continuous length of accordion-like folded web of towels of tissue paper or nonwoven comprising bundles 12 of a continuous length of accordion-like folded web of towels of tissue paper or nonwoven. The bundles 12 comprise connecting means 13 between the bundles 12. The dispenser 7 comprises a guiding element 14 in the form of a curved plate which extends over a segment of the web-supporting roller surface 15. The at least one web 16 is arranged to be fed through the guiding element 14 when the dispenser 7 is in use, and at least one part of the guiding element 14 is arranged to bear against the web 16. The guiding element 14 thereby holds the at least one web 16 in place on the roller surface 15 so that it does not move backwards or sidewards during the use of the dispenser, or in case of web-breakage.

The unit subsequent to the guiding element 14 is separation unit 1 described above. The separation unit 1 provides an optimal pinch force acting on the web material 16, and allows the web material 16 to be separated at the desired position. The separation unit 1 depicted in FIG. 4 is configured such that both of the rollers 2, 3 are positioned inside the housing 10. It is also conceivable that one of the rotational axes is located in the outer front wall 8, such that when the outer front wall 8 is opened, the pinch force caused by the separation unit 1 is released.

The dispenser 7 illustrated in FIG. 4 comprises a stack of interfolded webs 16, whereby the dispenser 7 is configured so that a preceding stack of interfolded webs in the housing 10 has to be lifted to position a new, succeeding stack in the housing 10 underneath the preceding stack to refill the dispenser 7. Stacks of interfolded webs in the dispenser 7 may be interconnected via connecting means 13, such as adhesive, adhesive tape or mechanical fasteners, such as hook and loop fasteners, at the bottom and/or top of each of the refill stacks. The web 16 is arranged to be fed upwards within the housing 10, around the roller 15 located at the top of the dispenser 7 and downwards towards the separation unit 1 and the dispensing opening 17.

Figure 5:
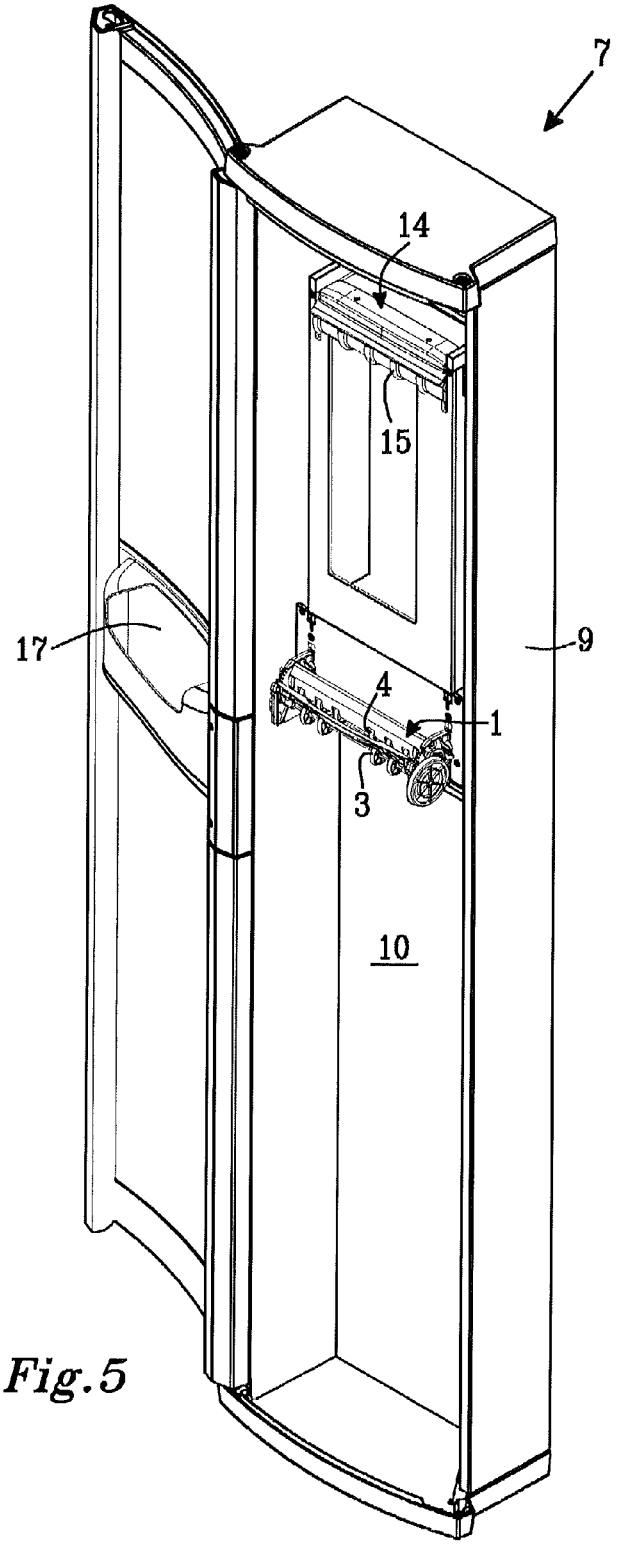

In FIG. 5 the dispenser 7 is depicted in the state when no web material 16 is loaded. The separation unit 1 is positioned within the housing 10 at the same level as the dispensing opening 17, such that the perforated web 16 is separated along the preformed lines of weakness at the moment of dispensing with almost no effort from the user's side.

It should be noted that the dispenser 7 according to the present invention may be any type of automatic or non-automatic dispenser for dispensing at least one web, i.e. a plurality of webs may be dispensed simultaneously, or a plurality of different webs may be dispensed by the dispenser 7 one at a time.

The dispenser 7 is a free-standing, but the dispenser may also be mounted on any suitable object in any suitable manner. Furthermore, a dispenser housing 10 of a dispenser according to the present invention need not necessarily contain an entire web 16 that is to be dispensed by the dispenser 7. At least one web 16 may for example be stored outside the housing 10 and merely be fed through the housing 10 when the dispenser 7 is in use.

Although the present invention has been described with reference to various embodiments, those skilled in the art will recognise that changes may be made without departing from the scope of the invention. It is intended that the detailed description be regarded as illustrative and that the appended claims including all the equivalents are intended to define the scope of the invention.

The invention claimed is:

1. A separation unit for separating a web material along preformed lines of weakness, said separation unit having a width direction and comprising:

a first roller having a rotational axis extending in said width direction and a web width extending in said width direction, and a second roller having a rotational axis extending parallel with said rotational axis of said first roller and a web width extending in said width direction, said second roller being positioned at a distance from said first roller, said distance extending in a direction perpendicular to said width direction, wherein each of said first and said second rollers is provided with a plurality of protrusion elements being spaced along said rotational axes and protruding perpendicularly from said axes, wherein each of said protrusion elements has a maximum width in said width direction, a maximum radial extension from said rotational axes, an inner portion adjacent to said rotational axes, and an outer portion remote from said rotational axes, wherein said outer portions of said protrusion elements on said first roller are arranged in a staggered relationship with said outer portions of said protrusion elements on said second roller, and wherein said outer portions of said protrusion elements on said first roller are partially overlapping with said outer portions of said protrusion elements on said second roller with a radial overlap length, thus forming an undulating passage for a web material between said rollers, wherein each protrusion element has a maximum width along the width direction within the overlap length, and the sum of said maximum widths within the overlap length of all protrusion elements on one of said rollers is between 5-30% of said web width of that roller, wherein the separation unit is configured to create a pinch force on the web material, wherein the pinch force separates the web material along preformed line of weakness via passage through the separation unit.

2. The separation unit according to claim 1, wherein said outer portions of said protrusion elements have ribbed surfaces.

3. The separation unit according to claim 1, wherein said protrusion elements have same maximum radial extensions and same maximum widths.

4. The separation unit according to claim 1, wherein said spacing between each two protrusion elements is equal to or greater than said maximum width of each protrusion element.

5. The separation unit according to claim 1, wherein said maximum radial extensions of said protrusion elements are equal to or greater than said maximum widths of said protrusion elements.

6. The separation unit according to claim 1, wherein said maximum radial extensions of said protrusion elements are between 5-50 mm.

7. The separation unit according to claim 1, wherein the maximum widths of said protrusion elements are between 4-20 mm.

8. The separation unit according to claim 1, wherein said protrusion elements are arranged with same spacing in different parts of said first and/or said second roller.

9. The separation unit according to claim 1, wherein at least one of said first and said second rollers comprises at least a first, a second and a third protrusion element, wherein the spacing between said first and said second protrusion elements along the width direction of said first and/or said second roller differs from the spacing between said second and said third protrusion elements along the width direction of said first and/or said second roller.

10. The separation unit according to claim 1, wherein each of said first and said second rollers has a central portion and outer portions in said width direction, and wherein said spacing between said protrusion elements is greater in said central portion than in said peripheral portions.

11. The separation unit according to claim 1, wherein said radial overlap length is between 2-40 mm.

12. The separation unit according to claim 1, wherein said distance between said rotational axes of said first and said second rollers is between 8-100 mm.

13. The separation unit according to claim 1, wherein said protrusion elements are formed integral with said first and/or second roller.

14. The separation unit according to claim 1, wherein said protrusion elements are separate units attached to said first and/or second roller.

15. The separation unit according to claim 1, wherein said distance between said rotational axes of said first and said second rollers is adjustable.

16. The separation unit according to claim 1, wherein said protrusion elements are disc elements.

17. A dispenser for a web material, comprising a housing defining a web material reservoir;

a dispensing opening;

a control unit;

a separation unit according to claim 1.

18. The dispenser according to claim 17, wherein the dispenser is adapted for containing a web material comprising preformed lines of weakness, said web material being Z-folded to form a stack.

19. The dispenser according to claim 17, wherein the dispenser is adapted for containing a web material comprising preformed lines of weakness, said web material being in the form of a roll.

20. The dispenser according to claim 17, wherein the dispenser further comprises a feeding mechanism.

21. The dispenser according to claim 17, wherein said web material is contained in said reservoir, and wherein a leading portion of said web material is supported in a dispensing path from said reservoir to said dispensing opening.

22. The dispenser according to claim 21, wherein said leading portion extends upwardly from the top of the said stack of said web material.

23. The dispenser according to claim 17, wherein said separation unit is configured to separate a web material having preformed lines of weakness having the perforation strength between 20-80 N/m.

24. The dispenser according to claim 17, wherein said separation unit is configured to separate web material that comprises:

at least a first layer divided into sheet products defined between longitudinally separated lines of weakness extending across the first layer; and at least a second elongate web divided into sheet products defined between longitudinally separated lines of weakness extending across the second layer;

wherein the webs are interfolded so that the lines of weakness of the first web are offset from the lines of weakness of the second web in a longitudinal direction of the first web.

* * * * *